United States Patent [19]

Lesowsky

[11] 4,354,375

[45] Oct. 19, 1982

[54] TOOL FOR OPERATING WALL ANCHORS

[76] Inventor: Joseph Lesowsky, 335 E. Taft Ave., Orange, Calif. 92665

[21] Appl. No.: 178,544

[22] Filed: Aug. 15, 1980

[51] Int. Cl.[3] ..... B21J 9/18

[52] U.S. Cl. ..... 72/449; 29/243.53; 29/267; 29/283.5; 29/522 R; 254/95

[58] Field of Search ..... 29/244, 243.53, 267, 29/283.5, 522 R, 526 R; 254/95, 18, 6 R, 12; 411/29, 34, 35, 36, 37, 38, 55; 72/449, 391

[56] References Cited

U.S. PATENT DOCUMENTS

| | | | |
|---|---|---|---|
| 560,056 | 5/1896 | Arnold | 254/95 |
| 696,866 | 4/1902 | Fryk et al. | 254/95 |
| 1,008,694 | 11/1911 | Bryant | 254/95 X |
| 1,939,480 | 12/1933 | Wilson | 254/95 X |
| 2,017,421 | 10/1935 | Post | 411/38 |
| 2,115,251 | 4/1938 | Buck | 72/449 |
| 2,148,977 | 2/1939 | Buck | 411/38 |
| 2,582,417 | 1/1952 | Croessant | 72/449 X |
| 2,668,569 | 2/1954 | Fat | 254/95 X |

*Primary Examiner*—Charlie T. Moon
*Attorney, Agent, or Firm*—Perry E. Turner

[57] ABSTRACT

Various forms of tools are disclosed for effecting reciprocal movements between jaw members to be located between and exerting opposing thrusts on the flange and bolt head of a hollow wall anchor. For such an anchor driven through a plaster wall or wallboard with the flange brought flush against the inner surface thereof, the threaded bolt is unthreaded sufficiently to position the jaws as described. Operation of the tool to thrust the jaws apart causes the bolt to be drawn out axially, carrying the inner end of the anchor so as to decrease the distance between flange and inner end and deforming the anchor body for interlocking it with the wall material. Where such an anchor is initially only partly driven through the wall, due to its inner end being obstructed, the bolt is unthreaded and the jaws located between the thus spaced head and flange in the same manner. However, thrusting the jaws apart in this instance results in the flange being driven into seating engagement with the inner wall surface, with accompanying deformation of the anchor body to interlock with the wall material. The tool in one embodiment employs an adjustable fulcrum for a lever via which to move a bar carrying one of the jaws relative to the other jaw carried on a base. In other embodiments, reciprocal jaw action is effected via a rack and pinion drive, and a linear actuator.

3 Claims, 16 Drawing Figures

TOOL FOR OPERATING WALL ANCHORS

BACKGROUND OF THE INVENTION

1. Field of the Invention

This invention relates to hand tools, and more particularly to improved hand tool construction and method of expanding hollow wall anchors.

2. Description of the Prior Art

It is known to utilize hollow wall anchor elements to adapt plaster or dry walls to support cabinets, shelves and the like. A widely used wall anchor for this purpose is formed from a hollow sleeve with a flange at one end to seat against the inner surface of a wall, and which at its opposite end is threaded to receive the inner end of a threaded bolt. The body of the sleeve intermediate its end portions has spaced longitudinal slots, thereby forming the body as a cage of thin ribs—usually three in number. The bolt in an assembled anchor is threaded in so the bolt head bears against the flange. The inner end of the bolt may extend through the threaded end of the sleeve to threadedly engage a coned element which, together with a pointed end for the bolt, facilitates driving the anchor through a wall. Alternatively, holes may be drilled in the wall to slidably receive such anchor elements.

Such wall anchors as heretofore employed are intended to be inserted through walls with their flanges seated against the inner surface of such a wall. Thus positioned, anchoring of each element is effected by turning the bolt head against the flange with a screwdriver so as to draw the threaded end of the anchor towards the wall. Such movement is facilitated by deformation of the ribs, which are forced into the wall material to interlock therewith.

Heretofore, such wall anchors have not been useful in situations where they cannot be driven or inserted through a wall so that, initially, their flanges are seated against the inner wall surfaces. Where the inner ends of such anchors are obstructed, e.g., as by coming against a concrete pillar or wall located behind the plaster or dry wall into which they are driven, their flange ends are spaced from the inner surface of the plaster. Accordingly, turning of the threaded bolt cannot effect action of the parts of the anchor element as required to anchor it in the wall material. Where the structural strength of such an anchor is required at that type of location, resort must be to a different type of support, e.g., toggle bolts, having the desired strength but requiring substantially different operations to effect their use. Further, such situations cause undesired delays in determining that a given anchor cannot be used and that a different type of support must be found and used in lieu thereof.

SUMMARY OF THE INVENTION

This invention embraces a method and apparatus for operating deformable, hollow wall anchors via axial movement of their bolts to effect their deformation and anchoring properly in a wall whether or not they can initially be inserted to their full lengths. This invention includes the method of unscrewing the bolt to establish clearance between the bolt head and the anchor flange, and applying oppositely directed axial forces on such head and flange to effect their axial separation so as to effect both seating of the flange and deformation of the anchor body to anchor it in the wall material. Further, this invention embraces tools having jaw members adapted to engage confronting portions of such bolt heads and flanges, and operable to effect their separation axially to properly anchor such element in the wall material. This invention embraces, further, such tools operable manually and via a source of power such as electromechanical power.

DESCRIPTION OF ILLUSTRATIVE EMBODIMENTS

Figure 1:
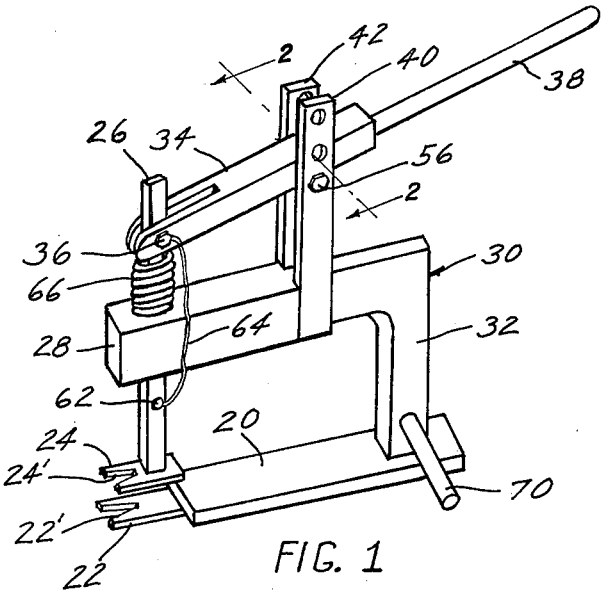
FIG. 1 is a perspective view of a tool in accordance with this invention, showing a lower jaw fixed to a base and an upper jaw carried on a reciprocally movable bar operable via a lever, with adjustable fulcrum means for the lever.

Referring to FIG. 1, there is shown a hand tool wherein a base 20 has a jaw member 22 secured to and extending from one end thereof. A second jaw 24 is carried on one end of a bar 26 which is slidable through an arm 28 of an L-shaped member 30 that has its other arm 32 secured to the base 20. A lever 34 is adapted at one end to straddle the bar 26, and is connected to the bar at 36 to insure movement of the bar and the jaw 24 thereon with movements of the lever 34, which is effected via force applied to a handle 38 extending from the lever.

Figure 2:
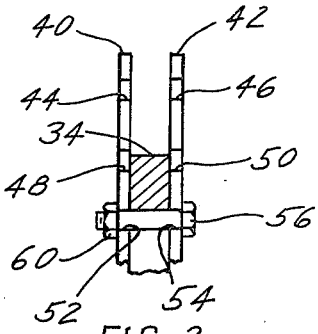
FIG. 2 is a fragmentary sectional view taken along the line 2—2 of FIG. 1.

Referring to FIG. 2 along with FIG. 1, the lever is provided with a selectively positionable fulcrum, and to this end plates 40, 42 extending from the sides of the arm 28 are provided with aligned pairs of openings 44–46, 48–50, 52–54. A pin or bolt 56 is shown extending through the lower pair of openings 52–54, and suitably secured at 60, so the lever 34 rests on the pin 56. Applying downward or inwardly directed force on the handle 38 thus causes the lever to pivot on the pin 56 to cause the bar 26 and its jaw 24 to move away from the jaw 22. The fulcrum pin can quickly be removed and relocated as desired to effect such pivotal movement of the lever as needed for the extent of reciprocal jaw movements that may be required.

In this latter regard, a stop pin or limit pin 62 may be removably inserted in the bar 26 below the arm 28. Or the bar 28 may be provided with a number of spaced openings for such a limit pin. The placement of such a pin determines the maximum separation of the jaws 22, 24 that may be permitted. The limit pin may be removed when such limitation is not desired. A convenient keeper cord 64 connecting the pins 36, 62 prevents loss of pin 62 when it is removed from the bar 26. Also, as indicated in FIG. 1, a spring 66 may be positioned on the bar 26 between the arm 28 and lever 34. With the ends of the spring 66 attached to the lever 34 and arm 28, removal of force on the handle 38 causes the bar 28 to return to a position of minimum clearance between the jaws 22, 24. As will be appreciated, the parts may be arranged and dimensioned to effect abutment of the jaws by the return spring 66 when there is no force on the handle. Also, to aid in operation of the tool, a handle 70 may be attached to the arm 32. Desirably, suitable provision is made to permit the handle 70 to be threaded into place on either side of the arm 32, depending upon whether the operator is left- or right-handed.

Figure 3:
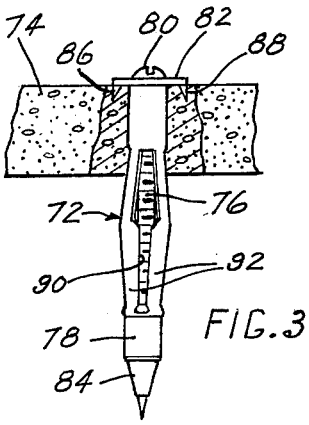
FIG. 3 is a fragmentary sectional view of a plaster wall or wallboard through which a hollow wall anchor has been driven to seat its flange on the outer surface of the wall.

FIG. 3 illustrates a widely used hollow wall anchor 72 driven through a plaster or dry wall 74. To facilitate driving the anchor 72, a threaded bolt 76 extends through the hollow body to threadedly engage the inner end portion 78. The bolt head 80 is in abutment with the flange 82. The inner end of the bolt is pointed, and a coned element 84 is threaded on the portion of the bolt immediately adjacent the body portion 78. The coned element 84 may be metal or plastic, and coacts with the pointed end of the bolt to facilitate passage of the anchor through the wall 74 when the head 80 is struck with a hammer. When struck with a hammer to drive the anchor through, the flange 82 is seated against the outer wall surface. The flange has pointed ears 86, 88 struck therefrom which penetrate the wall material and prevent the hollow body of the anchor from rotating as the anchor body deforms, penetrating to interlock the anchor with the wall material.

In this latter regard, the main body portion of the anchor is provided with spaced longitudinal slots 90 so as to form spaced ribs 92. There are typically three such slots to provide three ribs 92. The ribs are slightly bent outward intermediate their ends, as will be observed in FIG. 3. As previously indicated, the ribs are deformed to cause the ribs to interlock with the wall material. Also as explained, this is accomplished in prior art practice by inserting the blade of a screwdrive in the slot of the bolt head 80 and turning the head while keeping it flush against the flange 82. Such turning of the bolt causes the inner body portion 78 threaded thereon to be drawn towards the wall 74. The ribs 92 deform due to the applied force, and such deformation forces the upper portions of the ribs into the wall material so they interlock therewith.

Undesirably, the ears 86, 88 on the flange 82 may be forced to cut through the wall material, i.e., they may not withstand the considerable torque applied when the bolt is turned. This is particularly so where the anchor is not struck hard enough to firmly seat the flange in place. It then is a formidable task to try and hold the flange against angular movement while turning the bolt so as to deform and anchor the body in the wall material.

Figure 4:
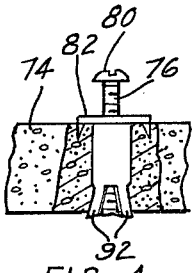
FIG. 4 is a fragmentary sectional view of the wall of FIG. 3, showing the bolt unthreaded to establish spacing between the bolt head and the anchor flange.
Figure 5:
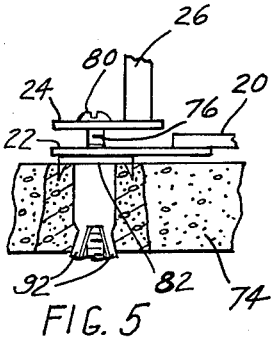
FIG. 5 is a fragmentary sectional view like FIG. 4, showing the jaws of the tool located between and engaging the bolt head and anchor flange.
Figure 6:
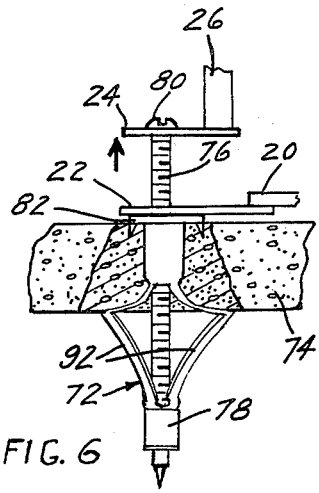
FIG. 6 is a fragmentary sectional view like FIG. 3, showing the bolt thrust outwardly from the wall via outward movement of the bolt head via outward movement of the outer jaw of the tool, such axial bolt movement effecting movement of the inner end of the anchor towards the wall to deform the slotted anchor body and interlock it with the wall material.

However, such disadvantages cannot occur with the method and apparatus of this invention. Referring to FIGS. 4–6 along with FIG. 3, the bolt 76 is partly unthreaded to space the head 80 from the flange 82 sufficiently to permit both jaws 22, 24 of the tool to be positioned between the head and flange. With reference to FIG. 1, it will be noted that the jaws have tapered notches 22′, 24′ to facilitate their being moved astride bolts of different diameters. With the jaw 22 positioned against the flange 82, inward force on the handle 38 causes the lever 34 to operate the bar 26 and jaw 24 to exert an outward thrust on the bolt head 80. This causes the bolt 76 to be drawn outwards axially, thus moving the inner body portion 78 towards the wall. The ribs 92 thus deform to penetrate the body material and thus lock the anchor in place. Following such locking in place of the anchor, the handle of the tool is released to permit the jaws to close towards each other. The tool is removed by moving the jaws away from the bolt. The bolt is then removed from the anchor element.

Comparing FIGS. 3 and 6, it will be noted that the coned element 84 in FIG. 3 is missing in FIG. 6. This element may move off the end of the bolt when it is unthreaded to the position in FIG. 4, or when the bolt is moved axially outward to the position in FIG. 6. In any event, such separate element will be dislodged upon removing the bolt after the operation shown in FIG. 4.

Figure 7:
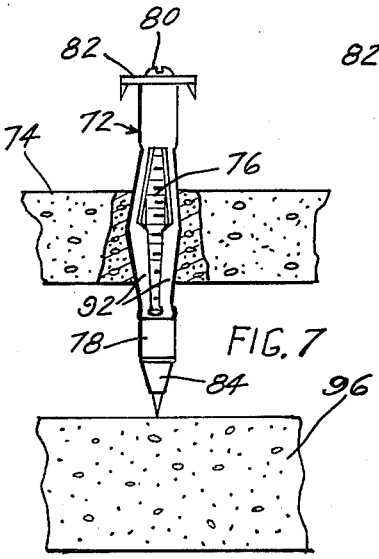
FIG. 7 is a fragmentary sectional view like FIG. 3, but showing concrete wall barrier which prevents the anchor from being inserted through the wall to its full length.

FIGS. 7–10 along with FIGS. 1 and 2 illustrate the method and apparatus of the invention to interlock such an anchor with the wall when the anchor cannot be driven through the wall to its full length. This situation is shown in FIG. 7, wherein the anchor 72 is driven only part way through because its inner end is obstructed by a concrete pillar or wall 96 located behind the wall 74. Prior art methods and apparatus are ineffective to permit such a hollow anchor to be used in this situation. As will be observed, turning the bolt 76 in FIG. 7 will not cause the desired deformation and interlocking of the body with the wall material. The body will simply be turned with the bolt if the bolt head 80 is turned against the flange 82.

Figure 8:
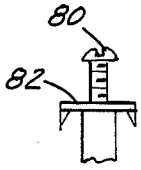
FIG. 8 is a fragmentary view in elevation of the portion of the anchor element of FIG. 7 spaced outwardly of the plaster wall, showing the bolt unthreaded as in FIG. 4.
Figure 9:
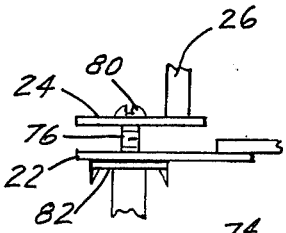
FIG. 9 is a fragmentary view in elevation like FIG. 8, showing the jaws of the tool in position as in FIG. 5.
Figure 10:
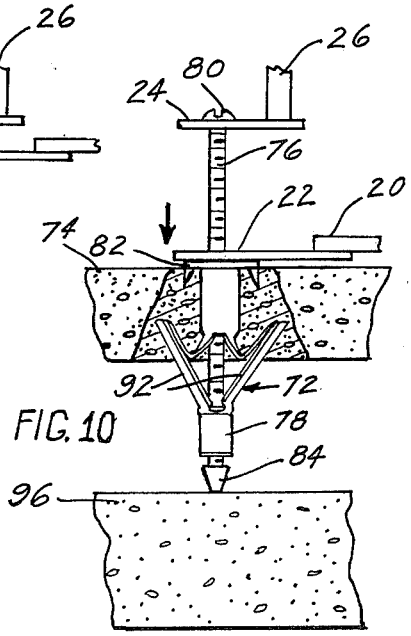
FIG. 10 is a fragmentary sectional view like FIG. 7, showing the lower jaw of the tool and flange of the anchor thrust inward to seat the flange in the outer wall surface, thereby deforming the split body portions of the anchor to interlock it with the wall material.

However, the method and apparatus of this invention does effect the desired anchoring of the body 72 in the wall 74. The same procedure is followed as previously described in partially unthreading the bolt 76 and locating the tool jaws 22, 24 between the bolt head 80 and flange 82. Thus, FIGS. 8 and 9 show these same steps depicted in FIGS. 4 and 5 when the anchor was driven fully through the wall. In this instance, however, operation of the tool and jaws, while thrusting the jaws apart as in the previous example, effects axial movement of the upper portion of the body 72, rather than axial movement of the bolt. As shown in FIG. 10, the lower jaw 22 forces against the flange 82 to move it flush to the wall 74. The ribs 92 deform due to such compressive forces, extending through and interlocking with the wall material. Comparison of FIGS. 6 and 10 reveals that the ribs deform differently in the two situations. In either case, however, the interlocking and anchoring is effected in the desired positive manner.

It will be noted in FIG. 10 that the coned element 84 is retained on the inner end of the bolt. When the bolt is partly unthreaded in the step shown in FIG. 8, the threaded engagement with the coned element 84 is removed, whereupon the coned element may move against the concrete wall 96. However, after the operation shown in FIG. 10, removal of the bolt from the body of the anchor frees such coned element to drop from the space between the inner body portion 78 and the concrete wall.

Figure 11:
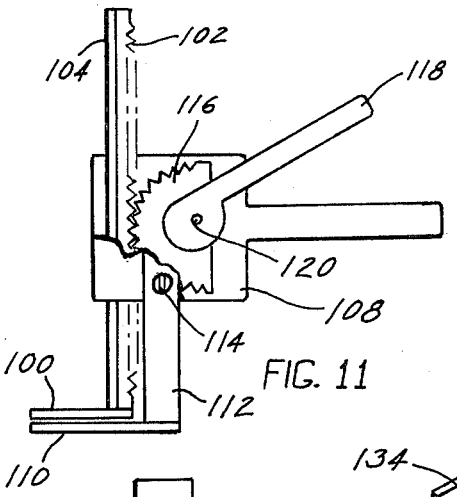
FIG. 11 is a side elevation view of another embodiment of hand tool of the invention in which the jaw movements are effected via rack and pinion combinations.
Figure 12:
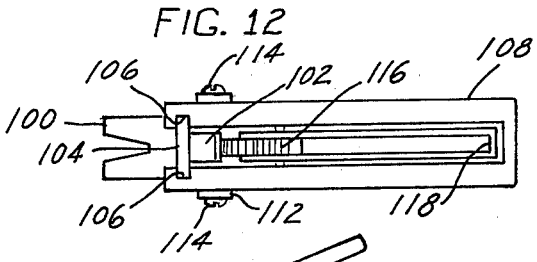
FIG. 12 is a top plan view of the tool of FIG. 11.
Figure 13:
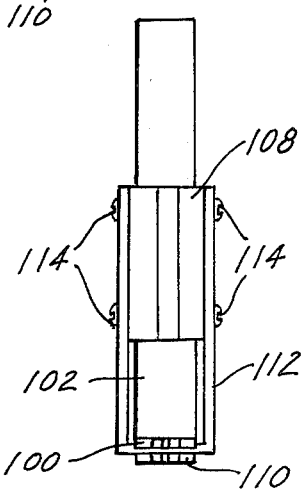
FIG. 13 is a front elevation view of the tool of FIG. 11.

FIGS. 11–13 show another embodiment of a tool in accordance with this invention. In this embodiment, one jaw 100 is carried on one end of a toothed rack 102. The rack is secured to a bar 104 which extends through and is slidable in grooves 106 of a frame member 108. Another jaw 110 is secured to a U-shaped bracket 112 that is secured at 114 to the frame 108. Accordingly, it will be seen that the rack 102 is adapted for movement in the frame so as to move the jaw 100 reciprocally relative to the jaw 110.

Such jaw action is effected via rack-and-pinion action. To this end, a section gear 116 is in mesh with the teeth of the rack 102. A U-shaped handle 118 straddles the gear, and such gear and handle are secured to a pin 120 (FIG. 11) that is journaled at its ends in the sides of the frame 108 for rotation. This tool may be operated by one hand, as by grasping the frame with the fingers and the handle with the thumb so as to force the handle into the frame or through the frame, depending upon the movement of the jaw 100 required.

Figure 14:
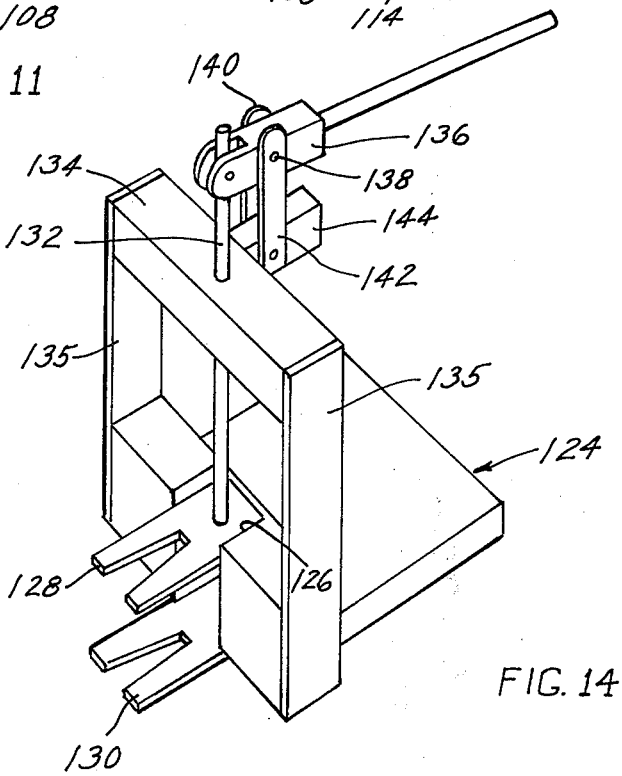
FIG. 14 is a perspective view of a further embodiment of hand tool of the invention, showing a pivotally mounted lever for axially moving a rod that carries one jaw slidable in a guideway.

In another embodiment of a hand tool of the invention shown in FIG. 14, a base 124 is provided with a guide channel 126 for a jaw 128 that is to be reciprocally moved relative to a jaw 130 that is fixed to the base. The jaw 128 is secured to a rod 132 which extends through a block 134 that is spaced from and secured at 135 to the base. The end of the rod 132 is pinned to a lever 136 which is pivotal on a pin 138 extending through plates 140, 142 that are secured to a member 144 extending from the block 134. As will be seen, operation of the lever 136 causes the rod 132 to slide in the block 134, and the rod 132 is prevented from undergoing angular movement by virtue of the jaw 128 being captured within the channel so as to movable only with axial movement of the rod 132.

Figure 15:
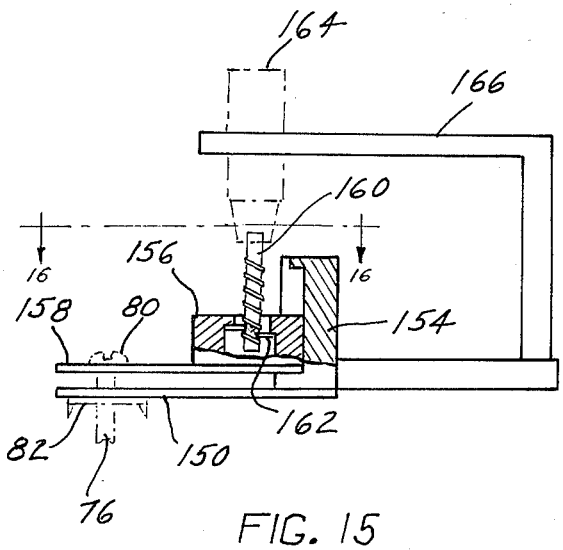
FIG. 15 is a fragmentary sectional view in elevation of a power operated tool in accordance with the invention, wherein the upper jaw is adapted for reciprocal movement as part of a linear actuator drive operable by a conventional drill.
Figure 16:
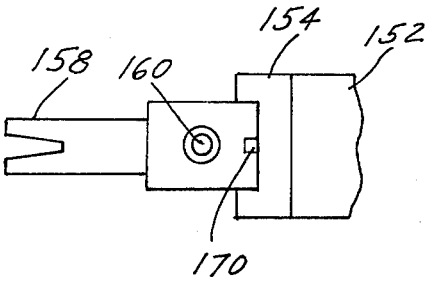
FIG. 16 is a fragmentary plan view taken along the line 16—16 of FIG. 15.

FIGS. 15 and 16 illustrate an embodiment of a tool in accordance with the invention in which reciprocal jaw movements are effected via a power tool. In this embodiment, one jaw 150 is secured to a base 152. The base includes a channel portion 154 in which a block 156 is slidable. A jaw 158 is secured to the block 156 so as to be moved relative to the jaw 150 as the block is moved through the channel.

Slidable movement of the block 156 is effected via a linear actuator type drive 160, 162. In this embodiment, the screw element is adapted to be engaged in the chuck of a power drill, illustrated in phantom at 164. If desired, a support bracket may be provided for supporting the power drill. Also, a limit stop pin 170 may be positioned in the outer portion of the channel 154 to prevent the block 156 from being dislodged from the channel.

It should be observed that the jaws for a tool in accordance with this invention may be of such size as to accommodate all sizes of wall anchor bolts. The notches therein are shown to be tapered with straight sides, but this invention can be seen to embrace various forms for the jaws and notches therein. For example, the notches may be curved. Or the notch in the lower jaw may be curved, with the body of the lower jaw shaped to seat against a substantial surface area of the flange of an anchor. Further, the tool may be provided with split jaws, e.g., the lower jaw or upper jaw, or both, may have two portions adapted to engage diametrically opposed portions of the anchor element—bolt head or flange—that it is to exert thrust on.

I claim:

1. A tool for deforming the tubular body of a flanged wall anchor having a headed bolt comprising, in combination:

an upstanding base member;

a first notched jaw member secured to the lower end of said base member;

a bar;

a second notched jaw member parallel to and coextensive with said first jaw member, said second jaw member being secured to one end of said bar;

a frame member fixed to the other end of said base member and having an integral handle parallel to said jaw members, said bar being slidable in said frame member;

a movable handle supported by said frame member for pivotal movement toward and away from said integral handle, said handles being adapted to be gripped by hand to force them together;

and means coupling said one end of said movable handle to said bar and operable on movement of said movable handle away from and toward said integral handle to effect sliding movement of said bar in said frame member, thereby to effect movement of said second jaw member toward and away from said first jaw member, said jaw members being adapted for insertion insertion between the bolt head and flange of the wall anchor to straddle the bolt with the notches in the jaw members and to thrust the bolt head and flange axially apart and effect deformation of the body of the anchor, said coupling means being characterized by a mechanical advantage that permits such deformation with a single closing together of said handles.

2. The combination of claim 1, wherein said coupling means includes a toothed rack integral with said bar;

a gear meshing with said rack and rotatable by and with said movable handle;

and a pin rotatable in said frame member, said gear and movable handle being fixed to said pin.

3. The combination of claim 2, wherein said base member is a U-shaped member, and said frame member with said integral handle comprise a U-shaped member, said base and frame members having their sides secured together adjacent their ends, said pin being journaled in the sides of said frame member, said gear being a sector gear that is centered on said pin, and said one end of said movable handle being shaped to straddle said gear.

* * * * *